US005327725A

United States Patent [19]

Mitsubori

[11] Patent Number: 5,327,725

[45] Date of Patent: Jul. 12, 1994

[54] EXHAUST GAS RECIRCULATION SYSTEM FOR A TURBOCHARGED ENGINE

[75] Inventor: Ken Mitsubori, Yokohama, Japan

[73] Assignee: Ishikawajima-Harima Jukogyo Kabushiki Kaisha, Tokyo, Japan

[21] Appl. No.: 106,654

[22] Filed: Aug. 16, 1993

[30] Foreign Application Priority Data

Aug. 24, 1992 [JP] Japan ..... 4-246061

[51] Int. Cl.[5] ..... F02M 25/07; F02D 21/08

[52] U.S. Cl. ..... 60/605.2

[58] Field of Search ..... 60/605.2; 123/568

[56] References Cited

U.S. PATENT DOCUMENTS 4,250,711 2/1981 Zehnder ..... 60/605.2

FOREIGN PATENT DOCUMENTS 54-12041 1/1971 Japan ..... 60/605.2

*Primary Examiner*—Michael Koczo

*Attorney, Agent, or Firm*—Oblon, Spivak, McClelland, Maier & Neustadt

[57] ABSTRACT

Resonance of a compressor impeller is prevented even when there are any pulsations in exhaust gas from an engine. An annular chamber in a diffuser defining wall of the compressor is connected with an outlet of a circulation passage for leading part of exhaust gas. An inner periphery of the chamber is communicated with the diffuser through an annular slit.

2 Claims, 2 Drawing Sheets

EXHAUST GAS RECIRCULATION SYSTEM FOR A TURBOCHARGED ENGINE

BACKGROUND OF THE INVENTION

The present invention relates to an exhaust gas recirculation system for recirculatingly using part of exhaust gas from an engine so as to purify the exhaust gas.

Exhaust gas recirculation is known as one solution for purifying exhaust gas from an engine of a vehicle such as automobile. In such exhaust gas recirculation, part of the exhaust gas is taken out of an exhaust system of the engine, is returned to a suction system and is added to the air-fuel mixture. This increases the ratio of inert gas such as $H_2O$, $N_2$ and $CO_2$ in a combustion air-fuel mixture and decreases combustion temperature so that generation of $NO_x$ is suppressed. However, when excessive quantity of exhaust gas is recirculated, combustion becomes unstable and both HC level and fuel consumption increase. Therefore, it is necessary to control exhaust gas recirculation quantity within a certain limit at which a desired $NO_x$ level and engine stability are compatible.

FIG. 1 shows an example of the above-mentioned exhaust gas recirculation applied to an engine with a turbocharger (Japanese Utility Model 1st Publication or Laid-Open No. 1-173445). More specifically, in a turbocharger 1 with a turbine 2 and a compressor 3 integrated with each other through a bearing casing 4, the turbine 2 is connected to an exhaust manifold 6 which serves as an exhaust passage of the engine 5. The turbine 2 is driven by exhaust gas from the engine 5 to drive the compressor 3 where compressed suction air is supplied through a suction passage 7 to the engine 5. A circulation passage 8 is provided between the exhaust manifold 6 and a downstream portion of the suction passage 7 so as to pass part of the exhaust gas G from the engine 5 through the circulation passage 8 to the suction passage 7 for recirculation. Further, control valves 10 and 11 are provided respectively at an inlet and an outlet of the circulation passage 8 and are controlledly opened and closed by a controller 9.

In the above conventional system, the circulation passage 8 is connected at its outlet to the suction passage 7 where pressure has been increased by the compressor 3. Therefore, the exhaust gas sometimes flows in reverse direction depending upon pressure conditions, resulting in failure of properly joining the exhaust gas to the suction system.

To overcome this problem, it may be contemplated that the circulation passage 8 be connected to an upstream portion of the compressor 3. In this case, however, the compressor impeller will be contaminated to decrease performance of the turbocharger 1. Further, if there are any pulsations in the exhaust gas, pressure waves may be transmitted to the compressor impeller to cause resonance.

In view of the above, a primary object of the present invention is to provide an exhaust gas recirculation system in which part of exhaust gas from an engine having a turbocharger can be properly joined to a suction system without contaminating a compressor impeller and in which resonance of the compressor impeller is prevented even when there are any pulsations in the exhaust gas.

To attain the above object, in an exhaust gas recirculation system wherein a turbocharger with a turbine and a compressor integrated with each other is mounted on an engine, part of exhaust gas from the engine being joined back through a circulation passage to a suction system where air from the compressor is supplied to the engine, the present invention provides an annular chamber in a diffuser defining wall of said compressor, said chamber being connected with an outlet of said circulation passage, and a slit on said diffuser defining wall for communicating an inner periphery of said chamber with the diffuser.

A water-cooled jacket may be mounted on an outer surface of the diffuser defining wall.

The exhaust gas from the engine is introduced into the diffuser of the compressor having relatively low pressure so that the exhaust gas is introduced into the suction system without being hindered by compressor pressure. In this case, the compressor impeller is not contaminated since the diffuser is located downstream of the compressor impeller. Further, since the exhaust gas is passed to the chamber in the diffuser defining wall and then is introduced into the diffuser, any possible pulsation pressure in the exhaust gas is attenuated in the chamber and resonance of the compressor impeller is prevented.

When the water-cooled jacket is arranged on the diffuser defining wall, the chamber is cooled down to cool the exhaust gas passing through the chamber. Accordingly, the temperature of the gas passed to the engine can be decreased and this contributes to reduce the ratio of $NO_x$ content in the exhaust gas.

DETAILED DESCRIPTION OF THE PREFERRED EMBODIMENTS

Figure 1:
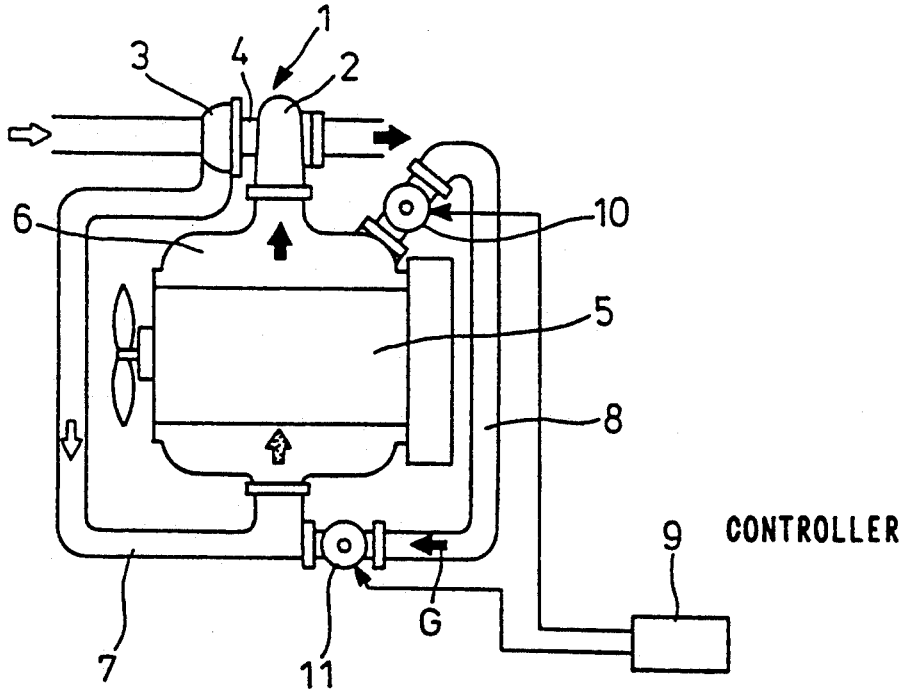
Fig.1 PRIOR ART
FIG. 1 is a schematic view of a conventional exhaust gas recirculation system.
Figure 2:
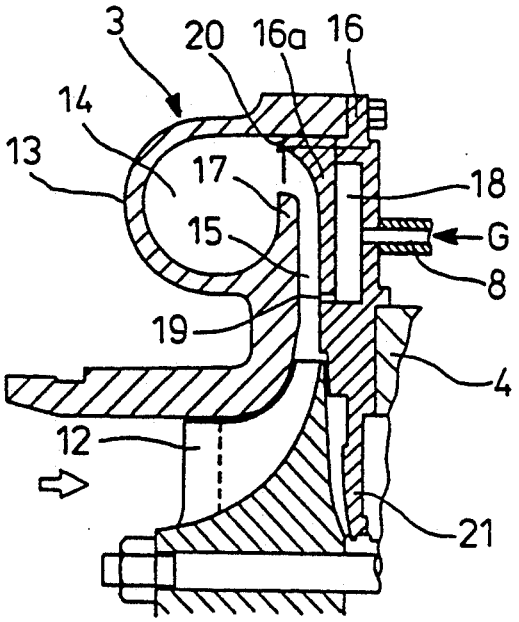
FIG. 2 is a sectional view of a compressor in a turbocharger in an embodiment of an exhaust gas recirculation system according to the present invention.

FIG. 2 represents an embodiment of the present invention which is similar to the conventional system shown in FIG. 1 in that a turbocharger 1 with a turbine 2 and a compressor 3 integrated with each other through a bearing casing 4 is mounted on an engine 5 and part of exhaust gas G from the engine 5 is joined back through a circulation passage 8 to a suction system where air from the compressor 3 is supplied to the engine 5 and which is differentiated from the prior art in that the exhaust gas G from the circulation passage 8 is introduced into a diffuser 15 which is defined between a compressor impeller 12 of the compressor 3 and a scroll 14 in a compressor housing 13 on an outer periphery of the compressor impeller 12.

More specifically, diffuser defining walls 16 and 17 which are portions of the compressor housing 13 face to each other to define the diffuser 15. An annular chamber 18 is arranged in the diffuser defining wall 16 adjacent to the bearing casing 4. The circulation passage 8 is connected at its outlet to an outer surface of the diffuser defining wall 16 for communication with the chamber 18. Further, a slit 19 is arranged on an inner surface of the diffuser defining wall 16 so as to communicate an inner periphery of the chamber 18 with the diffuser 15 so that the exhaust gas G fed from the circulation passage 8 into the chamber 18 is introduced through the slit 19 into the diffuser 15.

The diffuser defining wall 16 is separately furnished from the bearing casing 4 and an inner plate portion 16*a* directly defining the diffuser 15 is replaceably mounted by a bolt to adjust the dimension of the slit 19. Reference numeral 21 represents a seal plate integrally mounted on the inner periphery of the diffuser defining wall 16.

Part of the exhaust gas G from an exhaust manifold 6 (See FIG. 1) of the engine 5 is passed to the compressor 3 through the circulation passage 8, enters into the chamber 18 in the diffuser defining wall 16 and is then introduced into the diffuser 15 through the slit 19 on the inner periphery.

In the above arrangement, it is supposed that pressure at the discharge opening of the compressor 3 is 1; then, pressure in the diffuser 15 is about 0.6 and is relatively low so that part of exhaust gas G from the exhaust manifold 6 of the engine 5 is joined to the suction system without being hindered by the pressure of the compressor 3. The compressor impeller 12 is not contaminated by exhaust gas G since the diffuser 15 is positioned downstream of the compressor impeller 12. Even when exhaust gas G discharged from the engine 5 has pulsations, pressure waves caused by pulsation pressure are not transmitted to the compressor impeller 12 and resonance is prevented since exhaust gas G is passed into the chamber 18 for once before being introduced into the diffuser 15 and is converted into uniform flow all over the chamber 18. In the present invention, the diffuser defining wall 16 is designed separately from the bearing casing 4 and the inner plate portion 16*a* is designed to be replaceable so that it is possible to select mounting angle or exhaust gas flow rate by changing the diffuser defining wall 16 itself or the inner plate portion 16*a* thereof. This increases the flexibility of the system to comply with different specifications.

Figure 3:
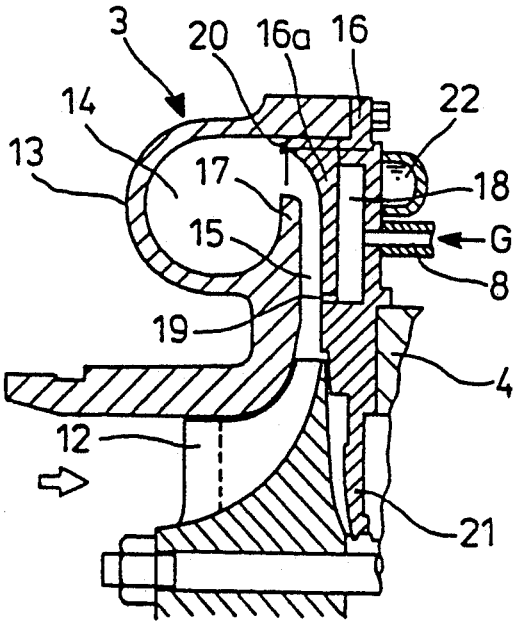
FIG. 3 is a sectional view of another embodiment of the present invention.

FIG. 3 shows another embodiment of the present invention which is similar to the embodiment shown in FIG. 2 except that a water-cooled jacket 22 is mounted on the outer surface of the diffuser defining wall 16 adjacent to the bearing casing 4. The chamber 18 in the diffuser defining wall 16 is cooled down by the water-cooled jacket 22.

In the embodiment of FIG. 3, the chamber 18 is cooled down by the water-cooled jacket 22 so that the exhaust gas G passed into the chamber 18 can be cooled down before it is introduced into the diffuser 15. Therefore, it is possible to decrease temperature of combustion air-fuel mixture in the engine 5 and to reduce $NO_x$ content.

It is to be understood that the present invention is not limited to the above-mentioned embodiments and that various modifications may be made without deviating from scope and spirit of the present invention. For example, the chamber 18 is formed in the diffuser defining wall 16 adjacent to the bearing casing 4 in the above-mentioned embodiments; however, the chamber 18 may be arranged in the diffuser defining wall 17 which is away from the bearing casing 4 and is faced to the diffuser defining wall 16, the circulation passage 8 being connected to the wall 17, the slit 19 being provided on the wall 17.

As described above, according to an exhaust gas recirculation system of the present invention, a chamber is arranged in a diffuser defining wall which constitutes a compressor of a turbocharger, part of exhaust gas from an engine being introduced through the chamber to a diffuser having relatively low pressure, so that part of the exhaust gas can be properly passed back to a suction system without being hindered by compressor pressure and without contaminating the compressor impeller. Even when there are pulsations in the exhaust gas, resonance of the compressor impeller is prevented since pressure waves in the exhaust gas are attenuated in the chamber before the exhaust gas is introduced into the diffuser. Further, provision of a water-cooled jacket for cooling the chamber can decreases the temperature of combustion air-fuel mixture and contributes to reduction of $NO_x$ content.

What is claimed is:

1. In an exhaust gas recirculation system wherein a turbocharger with a turbine and a compressor integrated with each other is mounted on an engine, part of the exhaust gas from the engine being joined back through a circulation passage to a suction system where air from the compressor is supplied to the engine, an improvement comprising an annular chamber in a diffuser defining wall of said compressor, said chamber being connected with an outlet of said circulation passage, and an annular slit on said diffuser defining wall for communicating an inner periphery of said chamber with the diffuser.

2. The system according to claim 1 wherein a water-cooled jacket is mounted on an outer surface of the diffuser defining wall.

* * * * *